US006729847B2

(12) United States Patent
Rossman

(10) Patent No.: US 6,729,847 B2
(45) Date of Patent: May 4, 2004

(54) BILGE PUMP SEAL AND FLOAT ACTUATOR

(75) Inventor: Christopher A. Rossman, Comstock Park, MI (US)

(73) Assignee: Attwood Corporation, Lowell, MI (US)

( * ) Notice: Subject to any disclaimer, the term of this patent is extended or adjusted under 35 U.S.C. 154(b) by 0 days.

(21) Appl. No.: 10/207,426

(22) Filed: Jul. 29, 2002

(65) Prior Publication Data

US 2004/0018094 A1 Jan. 29, 2004

(51) Int. Cl.[7] ..... F04B 49/04; F04B 35/04

(52) U.S. Cl. ..... 417/40; 417/423.3; 417/423.11; 310/87; 310/91

(58) Field of Search ..... 417/40, 423.3, 417/423.11; 310/87, 88, 91

(56) References Cited

U.S. PATENT DOCUMENTS

| | | | | |
|---|---|---|---|---|
| 3,046,900 A | * | 7/1962 | Pollack | 415/230 |
| 3,316,845 A | * | 5/1967 | Schumann | 417/40 |
| 3,717,420 A | | 2/1973 | Rachocki | |
| 3,800,462 A | | 4/1974 | Coyle | |
| 3,910,725 A | | 10/1975 | Rule | |
| 3,937,168 A | | 2/1976 | Doak | |
| 4,262,216 A | | 4/1981 | Johnston | |
| 4,275,995 A | | 6/1981 | Taylor | |
| 4,468,546 A | | 8/1984 | Jones | |
| 4,645,426 A | | 2/1987 | Hartley et al. | |
| 4,778,957 A | | 10/1988 | Crowell | |
| 4,904,830 A | | 2/1990 | Rizzuto | |
| 4,940,861 A | | 7/1990 | Rizzuto | |
| 5,044,883 A | | 9/1991 | Neueder | |
| 5,062,777 A | | 11/1991 | Carlsson | |
| 5,076,763 A | | 12/1991 | Anastos et al. | |
| 5,257,911 A | * | 11/1993 | Mota et al. | 417/63 |
| 5,265,551 A | | 11/1993 | Rosenblad | |
| 5,281,858 A | | 1/1994 | Langved | |
| 5,297,939 A | | 3/1994 | Orth et al. | |
| 5,419,271 A | | 5/1995 | Tweet et al. | |
| 5,538,406 A | | 7/1996 | Siegal et al. | |
| 5,562,423 A | | 10/1996 | Orth et al. | |
| 5,622,477 A | | 4/1997 | Orth et al. | |
| 5,636,586 A | | 6/1997 | Suganuma | |
| 5,814,780 A | | 9/1998 | Batchelder et al. | |
| 5,833,437 A | | 11/1998 | Kurth et al. | |
| 5,881,664 A | | 3/1999 | Suganuma | |
| 5,950,555 A | | 9/1999 | Damask | |
| 6,045,340 A | | 4/2000 | Batchelder et al. | |
| 6,056,881 A | | 5/2000 | Miller et al. | |
| 6,170,423 B1 | | 1/2001 | Suganuma | |
| 6,174,146 B1 | | 1/2001 | Lacy et al. | |
| 6,276,908 B1 | | 8/2001 | Batchelder et al. | |
| 6,390,780 B1 | * | 5/2002 | Batchelder et al. | 417/36 |

* cited by examiner

*Primary Examiner*—Charles G. Freay
(74) *Attorney, Agent, or Firm*—Price, Heneveld, Cooper, DeWitt & Litton, LLP.

(57) ABSTRACT

A bilge pump includes an outer housing having an interior wall separating a first cavity and a second cavity, an on/off electrical switch located within the first cavity, and a single-piece float located within the second cavity and having a float body and an actuator arm extending outwardly therefrom, wherein the float operably connects the electrical switch through an aperture in the interior wall, and wherein the float is configured such that the aperture remains above a water line within the second cavity during operation of the pump. The bilge pump also includes a motor having a motor housing having a hub and a power shaft extending from the hub, wherein the motor is located within the first cavity of the outer housing such that the hub of the motor housing is located within a hub of the first cavity, and seal member having a centrally located aperture receiving the power shaft therethrough, wherein the seal member is closely received about the hub of the motor housing and within the hub portion of the first cavity, thereby providing a water-tight seal about the power shaft and between the outer housing and the motor housing.

29 Claims, 2 Drawing Sheets

BILGE PUMP SEAL AND FLOAT ACTUATOR

BACKGROUND OF THE INVENTION

The present invention relates to a bilge pump, and in particular to a bilge pump providing a water-tight seal to a compartment located therein.

Bilge pumps are used in a wide variety of recreational water craft, including fishing boats, speed boats, and personal watercraft. These pumps typically include a float mechanism located within a housing and operably connected to a switch that operates a motor operably connected to an impeller for moving water.

Heretofore, the switches associated with bilge pumps are typically water-tight switches capable of being submerged, or are switches that are separated from the associated float and are located within a water-tight compartment within the pump. These pumps are typically susceptible to water leakage resulting in a short of the associated electrical switch. These pumps have also included sealing arrangements for sealing the motor within the water-tight compartment within the pump, and in particular, have included seal arrangements located about the associated shafts extending outwardly from the housing and operably connected to an impeller. Again, the seal arrangements typically used within these pumps are susceptible to water leakage, particularly due to misalignment between the power shaft of the motor and the housing within which it is located, as the previously used seal arrangements are located with respect to the housing and do not take into account the aforementioned misalignment of the motor and associated power shaft within the housing.

Accordingly, a bilge pump is desired that provides for adequate sealing of an associated electrical switch as well as an associated motor within the bilge pump.

SUMMARY OF THE INVENTION

One aspect of the present invention is to provide a bilge pump that includes an outer housing having an interior wall separating a first cavity and a second cavity, wherein the first cavity has a hub portion, and the second cavity is adapted to receive water defining a water line therein, and an on/off electrical switch located within the first cavity. The bilge pump also includes a single-piece float located within the second cavity and having a float body and actuator arm extending outwardly therefrom, wherein the float is operably connected with the electrical switch through an aperture in the interior wall such that movement of the float between a first position and a second position actuates the electrical switch, and wherein the float is configured such that the aperture within the interior wall remains above the water line during operation of the pump. The bilge pump further includes a motor including a motor housing having a hub and a power shaft extending from the hub, wherein the motor is located within the first cavity of the outer housing such that the hub of the motor housing is located within the hub portion of the first cavity, and a cup-shaped seal member having a centrally located aperture receiving the power shaft therethrough, wherein the seal member is closely received about the hub of the motor housing and closely received within the hub portion of the first cavity, thereby providing a water-tight seal about the power shaft and between the outer housing and the motor housing.

Another aspect of the present invention is to provide a bilge pump that includes an outer housing defining an interior cavity having a hub portion, and a motor including a motor housing having a hub and a power shaft extending from the hub, wherein the motor is located within the interior cavity of the outer housing such that the hub of the motor housing is located within the hub portion of the interior cavity. The bilge pump further includes a cup-shaped seal member having a centrally located aperture that receives the power shaft therethrough, wherein the seal member is closely received about the hub of the motor housing and is closely received within the hub portion of the interior cavity, thereby providing a water-tight seal about the power shaft and between the outer housing and the motor housing.

Yet another aspect of the present invention is to provide a bilge pump that includes an outer housing having an interior wall separating a first cavity and second cavity, wherein the second cavity is adapted to receive water defining a water line therein, and an on/off switch located within the first cavity. The bilge pump also includes a single-piece float located within the second cavity and having a float body and an actuator arm extending outwardly therefrom, wherein the float is operably connected with the electrical switch through an aperture in the interior wall such that movement of the float between a first position and a second position actuates the electrical switch, and wherein the float is configured such that the aperture within the interior wall remains above the water line during operation of the pump.

The present inventive bilge pump provides a more durable, efficient to use, and economical to manufacture pump. The present inventive bilge pump is capable of a long operating life due to the improved seal and sealing arrangements, and is particularly well adapted for the proposed use.

These and other advantages of the invention will be further understood and appreciated by those skilled in the art by reference to following written specification, claims and appended drawings.

DETAILED DESCRIPTION OF THE PREFERRED EMBODIMENTS

Figure 1:
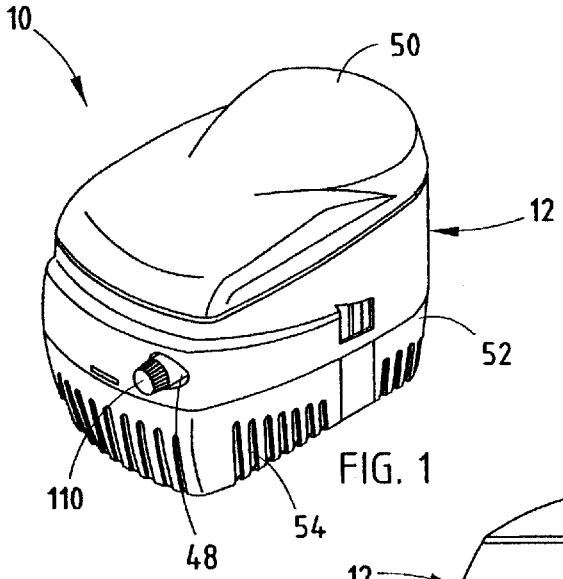
FIG. 1 is a top perspective view of a bilge pump embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
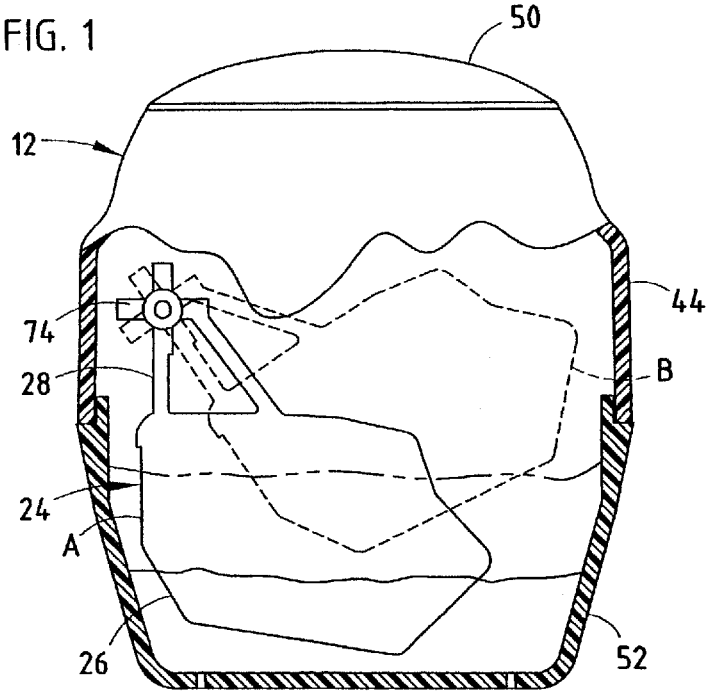
FIG. 3 is a cross-sectional side elevational view of the bilge pump along a line II—II, FIG. 1, with a float shown in a first lowered position and a second raised position in dashed line.
Figure 4:
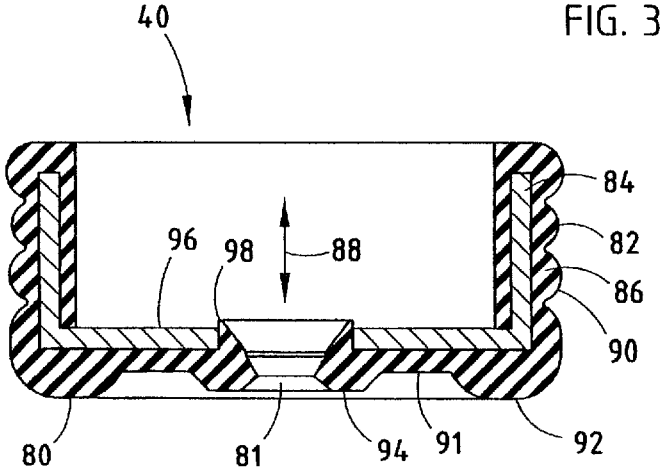
FIG. 4 is a cross-sectional side view of a seal of the bilge pump.
Figure 2:
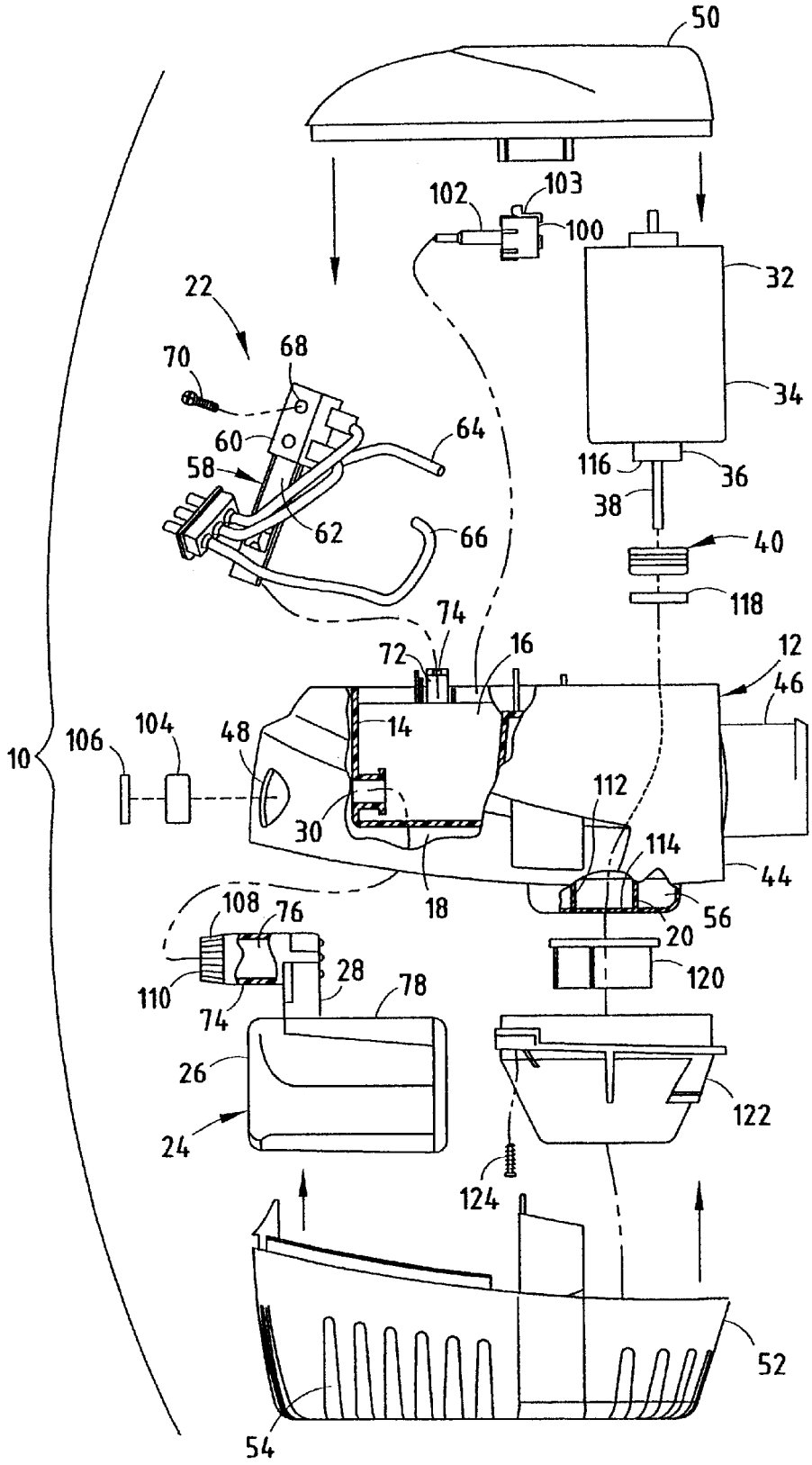
FIG. 2 is an exploded side view of the bilge pump with portions of the bilge pump cut-away to show internal components thereof.

The reference numeral 10 (FIGS. 1 and 2) generally designates a bilge pump embodying the present invention. In the illustrated example, the bilge pump 10 includes an outer housing 12 having an interior wall 14 separating a first cavity 16 from a second cavity 18, wherein the first cavity includes a hub portion 20, and wherein the second cavity is adapted to receive water defining a water line therein. The bilge pump also includes an on/off electrical switch 22 located within the first cavity 16, and a single-piece float 24 having a float body 26 and an actuator arm 28 extending outwardly therefrom. The float 24 is operably connected with the switch 22 through an aperture 30 extending through the interior wall 14 such that movement of the float 24 between a first position A (FIG. 3) and a second position B actuates the switch 22. The float 24 is configured such that the aperture 30 within the interior wall 14 remains above the water line during operation of the bilge pump 10, as described below. The bilge pump 10 further includes a motor including a motor housing 34 having a hub 36 and a power shaft 38 extending from the hub 36. The motor 32 is located within the first cavity 16 of the outer housing 12 such that the hub 36 of the motor housing 34 is located within the hub portion 20 of the first cavity 16. The bilge pump further includes a cup-shaped seal member 40 (FIG. 4) having a centrally located aperture 42 that receives the power shaft 38 therethrough. The seal member 40 is closely received about the hub 36 of the motor housing 34 and closely received within the hub portion 20 of the first cavity 16, thereby providing a water-tight seal about the power shaft 38 and between the outer housing 20 and the motor housing 34.

The outer housing 12 is preferably constructed of a durable plastic, however, other non-corrosive materials may also be utilized therefore. The outer housing 12 further includes a body portion 44 having an outlet pipe 46 integrally formed therewith, and an aperture 48 adapted to pivotally receive the float 24 therein, as described below. The outer housing 12 further includes an upper cover 50 that cooperates with body portion 44 to form the first cavity 16, and a lower basket 52 that cooperates with the body portion 44 to form the second cavity 18. The lower basket 52 includes a plurality of elongated venting slots 54 that allow water to enter the second cavity 18 of the outer housing 12. A plurality of radially extending support ribs 56 provide structural support to the hub portion 20 of the first cavity 16.

In the illustrated example, the electrical switch 22 includes a read-type electrical switch 58, having a body portion 60, a read 62, a common line 64 and a power line 66 operably connected to the motor 32. The body portion 60 includes an aperture 68 extending therethrough and adapted to receive mounting hardware such as screw 70 therein. In assembly, the body portion 60 of read switch 58 is placed between a pair of alignment walls 72, such that screw 70 is received within an aperture 74 located therebetween.

The float 24 further includes a cylinder portion 74 extending outwardly from and integrally formed with the actuator arm 28. The cylinder portion 74 includes a bore 76 extending therethrough. The float 24 is configured such that the actuator arm 28 extends upwardly from an upper surface 78 of the float body 26 and the cylinder portion 74 is located above the float body 24 when the float 24 is in the lowered position A.

The seal member 40 (FIG. 4) is provided a C-shaped cross-sectional configuration defined by an end wall 80 having a centrally located aperture 81 extending therethrough, and a side skirt 82. The seal member 40 comprises an inner core 84 constructed of a rigid material such as steel, copper, and the like, and an outer cover 86 constructed of a flexible material such as rubber, a polymeric substance, and the like. The inner core 84 is offset from the aperture 81 such that the aperture 81 is formed entirely by the outer cover 86, thereby allowing the materials surrounding the aperture 81 to deflect along the length of the power shaft 38 in a direction as indicated by directional arrow 88. The skirt 82 includes a plurality of raised ridges 90 extending about the circumference thereof. An outer surface 91 of end wall 80 includes a raised outer lip 92 extending circumferentially about the end wall 80 proximate the skirt 82, and a raised inner lip 94 extending circumferentially about the end wall 80 proximate the aperture 81. An outer surface 96 of the end wall 80 includes a raised inner lip 98 extending circumferentially about the end wall 80 proximate the aperture 81.

In assembly, an actuator 100 is pivotally received within aperture 30 of interior wall 14, and operably couples the switch 22 with the float 24. Specifically, a pivot pin 102 of the actuator 100 extends through the aperture 30 and is received within bore 76 of cylinder portion 74 of float 24. A coupling end 103 of the actuator 100 is operably coupled with the read 62 of the read switch 58, such that the read 60 is flexed by rotating the actuator 100. A seal 104 and a sealing disk 106 are located within the aperture 30 thereby sealing the same. An end 108 of the cylinder portion of the float 24 extends outwardly from the aperture 48 of the body portion 44 of the outer housing 12, and includes a plurality of ribs 110, thereby allowing for easy grasping of the float 24 and manual operation of the bilge pump 10. The seal member 40 is placed about the hub 36 of the motor housing 34, and the motor 32 is placed within the first cavity 16 of the outer housing 12 such that the hub 36 of the motor housing 34 and the seal member 40 are located within the hub portion 20 of the first cavity 16. The ridges 90 of the seal member 40 press against an outer wall 112 of the hub portion 20, while the outer lip 92 and the inner lip 94 of the seal member 40 press against a bottom wall 114 of the hub portion 20, and the inner lip 98 of the seal member 40 presses against an end wall 116 of the hub 36 of the motor housing 34. In an alternative embodiment, a sealing disk 118 is placed between the end wall 80 of the seal member 40 and the bottom wall 114 of the hub portion 20. An impeller 120 is then press fit onto power shaft 38, and in turn covered by a chamber cap 122. The first cavity 16 is then enclosed by upper cover 50, while second chamber 18 is enclosed by lower basket 52.

During operation, the water level within the second cavity 18 of the housing 12 changes causing the float 24 to pivot between the lowered position A and the raised position B, thereby activating the switch 22. It should be noted that the configuration of the float 24 and the location of the float within the second cavity causes the aperture 18 to remain above the water level at all times of operation of the pump. Further, the alignment of the seal 40 with respect to the hub 36 of the motor housing 34 dictates that the aperture of the seal 40 remain concentrically located about the shaft 38 of the motor 32 regardless of the alignment of the motor 32 within the housing 12.

In the foregoing description, it will be readily appreciated by those skilled in the art that modifications may be made to the invention without departing from the concepts disclosed herein. Such modifications are to be considered as included in the following claims unless these claims by their language expressly state otherwise.

What is claimed is:

1. A bilge pump, comprising:

an outer housing having an interior wall separating a first cavity and a second cavity, the first cavity having a hub portion, the second cavity adapted to receive water defining a water line therein;

an on/off electrical switch located within the first cavity;

a single-piece float located within the second cavity and having a float body and an actuator arm extending outwardly therefrom, the float operably connected with the electrical switch through an aperture in the interior wall such that movement of the float between a first position and a second position actuates the electrical switch, wherein the float is configured such that the aperture within the interior wall remains above the water line during operation of the pump;

a motor including a motor housing having a hub and a power shaft extending from the hub, the motor located within the first cavity of the outer housing such that the hub of the motor housing is located within the hub portion of the first cavity; and a cup-shaped seal member having a centrally located aperture receiving the power shaft therethrough, the seal member closely received about the hub of the motor housing and closely received within the hub portion of the first cavity, thereby providing a water-tight seal about the power shaft and between the outer housing and the motor housing.

2. The bilge pump of claim 1, wherein the seal member has a C-shaped cross-sectional configuration and includes an end wall and a perpendicularly extending skirt.

3. The bilge pump of claim 2, wherein the seal member comprises an inner core having a C-shaped cross-sectional configuration and constructed of a substantially rigid material, and an outer cover constructed of a substantially flexible material.

4. The bilge pump of claim 3, wherein the electrical switch includes a reed-type electrical switch.

5. The bilge pump of claim 4, wherein the float body and the actuator of the float are integrally formed.

6. The bilge pump of claim 5, wherein the float is operably connected to the switch via a pivot pin rotatably received within the aperture.

7. The bilge pump of claim 6, wherein the float further includes a cylinder portion integrally formed with the actuator arm and that receives the pivot pin therein.

8. A bilge pump, comprising:

an outer housing defining and interior cavity having a hub portion;

a motor including a motor housing having a hub and a power shaft extending from the hub, the motor located within the interior cavity of the outer housing such that the hub of the motor housing is located within the hub portion of the interior cavity; and a cup-shaped seal member having a centrally located aperture receiving the power shaft therethrough, the seal member closely received about the hub of the motor housing and closely received within the hub portion of the interior cavity, thereby providing a watertight seal about the power shaft and between the outer housing and the motor housing.

9. The bilge pump of claim 8, wherein the seal member has a C-shaped cross-sectional configuration and includes an end wall and a perpendicularly extending skirt.

10. The bilge pump of claim 9, wherein the seal member comprises an inner core having a C-shaped cross-sectional configuration and constructed of a substantially rigid material, and an outer cover constructed of a substantially flexible material.

11. The bilge pump of claim 10, wherein the aperture of the seal member is formed such that the outer cover may deflect along the length of the power shaft.

12. The bilge pump of claim 11, wherein the seal member includes at least one raised ridge extending circumferentially about the skirt and that contacts the hub portion.

13. The bilge pump of claim 12, further including:

a sealing disk constructed of a substantially flexible material and located between the end wall of the seal member and the hub portion.

14. The bilge pump of claim 13, wherein the seal member includes an outer raised lip extending circumferentially about the end wall proximate the skirt.

15. The bilge pump of claim 14, wherein the seal member includes an inner raised lip extending circumferentially about the end wall proximate the aperture.

16. The bilge pump of claim 8, wherein the seal member comprises an inner core having a C-shaped cross-sectional configuration and constructed of a substantially rigid material, and an outer cover constructed of a substantially flexible material.

17. The bilge pump of claim 8, wherein the aperture of the seal member is formed such that the outer cover may deflect along the length of the power shaft.

18. The bilge pump of claim 8, wherein the seal member includes at least one raised ridge extending circumferentially about the skirt and that contacts the hub portion.

19. The bilge pump of claim 8, further including:

a sealing disk constructed of a substantially flexible material and located between the end wall of the seal member and the hub portion.

20. The bilge pump of claim 8, wherein the seal member includes an outer raised lip extending circumferentially about the end wall proximate the skirt.

21. The bilge pump of claim 20, wherein the seal member includes an inner raised lip extending circumferentially about the end wall proximate the aperture.

22. A bilge pump, comprising:

an outer housing having an interior wall separating a first cavity and a second cavity, the second cavity adapted to receive water defining a water line therein;

an on/off electrical switch located within the first cavity;

a single-piece float located within the second cavity and having a float body and an actuator arm extending outwardly therefrom, the float operably connected with the electrical switch through an aperture in the interior wall such that movement of the float between a first position and a second position actuates the electrical switch; and wherein the float is configured such that the aperture within the interior wall remains above the water line during operation of the pump.

23. The bilge pump of claim 22, wherein the electrical switch includes a reed-type electrical switch.

24. The bilge pump of claim 23, wherein the float body and the actuator of the float are integrally formed.

25. The bilge pump of claim 24, wherein the float is operably connected to the switch via a pivot pin rotatably received within the aperture.

26. The bilge pump of claim 25, wherein the float further includes a tube-shaped portion integrally formed with the actuator arm and that receives the pivot pin therein.

27. The bilge pump of claim 22, wherein the float body and the actuator of the float are integrally formed.

28. The bilge pump of claim 22, wherein the float is operably connected to the switch via a pivot pin rotatably received within the aperture.

29. The bilge pump of claim 28, wherein the float further includes a cylinder portion integrally formed with the actuator arm and that receives the pivot pin therein.

* * * * *